US006398305B1

(12) United States Patent
Ball et al.

(10) Patent No.: US 6,398,305 B1
(45) Date of Patent: Jun. 4, 2002

(54) CHAIR WITH CONTINUOUSLY ADJUSTABLE SEATING ANGLE

(75) Inventors: Douglas Cameron Ball, Senneville; Ronald Walter Grube, Mississauga, both of (CA)

(73) Assignee: Arconas Corporation, Mississauga (CA)

( * ) Notice: Subject to any disclaimer, the term of this patent is extended or adjusted under 35 U.S.C. 154(b) by 0 days.

(21) Appl. No.: 09/667,580

(22) Filed: Sep. 22, 2000

(51) Int. Cl.[7] ..... A47C 1/02
(52) U.S. Cl. ..... 297/328; 297/327
(58) Field of Search ..... 297/328, 327, 297/344.19, DIG. 10

(56) References Cited

U.S. PATENT DOCUMENTS

| | | | | | |
|---|---|---|---|---|---|
| 1,725,427 | A | | 8/1929 | Stusak | |
| 2,132,363 | A | | 10/1938 | Thomas et al. | |
| 2,753,919 | A | | 7/1956 | Sill | |
| 3,810,674 | A | | 5/1974 | Svensson | |
| 3,902,755 | A | * | 9/1975 | Sirot | 297/339 |
| 4,432,582 | A | * | 2/1984 | Wiesmann et al. | 297/316 |
| 4,632,455 | A | | 12/1986 | Schiller et al. | |
| 4,819,986 | A | | 4/1989 | Markus | |
| 4,830,432 | A | | 5/1989 | Fuhrmann et al. | |
| 4,946,222 | A | * | 8/1990 | Matson | 297/345 |
| 5,061,010 | A | * | 10/1991 | LaPointe | 297/325 |
| 5,316,370 | A | * | 5/1994 | Newman | 297/313 |
| 5,383,709 | A | | 1/1995 | Chaney et al. | |
| 5,427,434 | A | | 6/1995 | Hybarger | |
| 5,651,580 | A | * | 7/1997 | LaPointe et al. | 297/85 |

* cited by examiner

*Primary Examiner*—Jerry Redman
(74) *Attorney, Agent, or Firm*—Ridout&Maybee LLP

(57) ABSTRACT

An adjustable chair, particularly for the use of attendees at meetings, is disclosed in which a gas cylinder is operatively connected between the underside of the chair seat and a lower cross-member to afford the user control of the lift and tilt of the chair over a range of positions.

7 Claims, 2 Drawing Sheets

CHAIR WITH CONTINUOUSLY ADJUSTABLE SEATING ANGLE

BACKGROUND OF THE INVENTION

This invention relates to adjustable tilt chairs and, more particularly, to an improved construction of chair with pneumatically controlled back and seat angle adjustment. A large number of adjustable chairs have been designed in the past which are intended for use in the seats of motor vehicles, aircraft, railway cars and buses, exemplified in U.S. Pat. No. 2,132,363 (Thomas et al.) and U.S. Pat. No. 3,810,674 (Svensson). Electrically or hydraulically controlled chairs having occupant assisting features whereby the back and seat members tilt as required to help the user in moving between seated and standing positions (e.g. orthopaedic chairs) are also exemplified in a number of prior patents, e.g. U.S. Pat. No. 4,632,455 (Schiller et al.) and U.S. Pat. No. 5,383,709 (Chaney et al.).

None of the existing designs are entirely satisfactory as chairs for use at meetings and lectures. Many known adjustable chairs have large and unwieldy bases which can lead to repetitive contact with and scuffing of the shoes of a user seated in a long and taxing meeting. Many known chairs have a good range of adjustability, but an adjustment mechanism whose use is overly obtrusive and insufficiently silent to lend itself to chairs around a boardroom table, for example.

SUMMARY OF THE INVENTION

It is an object of the present invention to provide a readily moveable adjustable chair with a pneumatic action having a simple lift lever manual control.

It is a further object of the invention to provide an improved chair as aforesaid which will permit continuous adjustment over a range of comfortable positions from a forward tilt (for poring over documents) to substantial recline for freeform conversation or solitary contemplation.

With a view to overcoming the disadvantages of the prior art and achieving the aforementioned objects, according to the invention there is provided a chair with adjustable seating angle which comprises a pair of vertical side walls, having contoured upper edge surface which serve as comfortable arm rests. These sides/arm rests of the chair are supported in spaced parallel relationship by an elongate cross-member extending between the walls below seat level. An integral chair back and seat assembly which is positioned between the side walls and pivotally mounted at the front of the seat portion thereof to the side walls for angular tilting under the action of pneumatic cylinder means connected between the centre of the cross-member and the underside of the seat portion. The tilting of the back/seat assembly is effected by manual actuating or deactuating of the pneumatic cylinder by a conveniently positioned control rod at the front of and just under the seat.

These and other objects and advantages of the present invention will be apparent from the detailed description which follows, when considered in conjunction with the accompanying drawings.

DETAILED DESCRIPTION OF THE INVENTION

A chair according to the invention comprises a spaced pair of vertical side panels 10*a* and 10*b*. In what follows, 10*a* and

10*b* will be referred to as the "arms" of the chair since they present contoured upper edge surfaces 11*a* and 11*b* which comfortably support the relaxed arms of the seated user.

Figure 1:
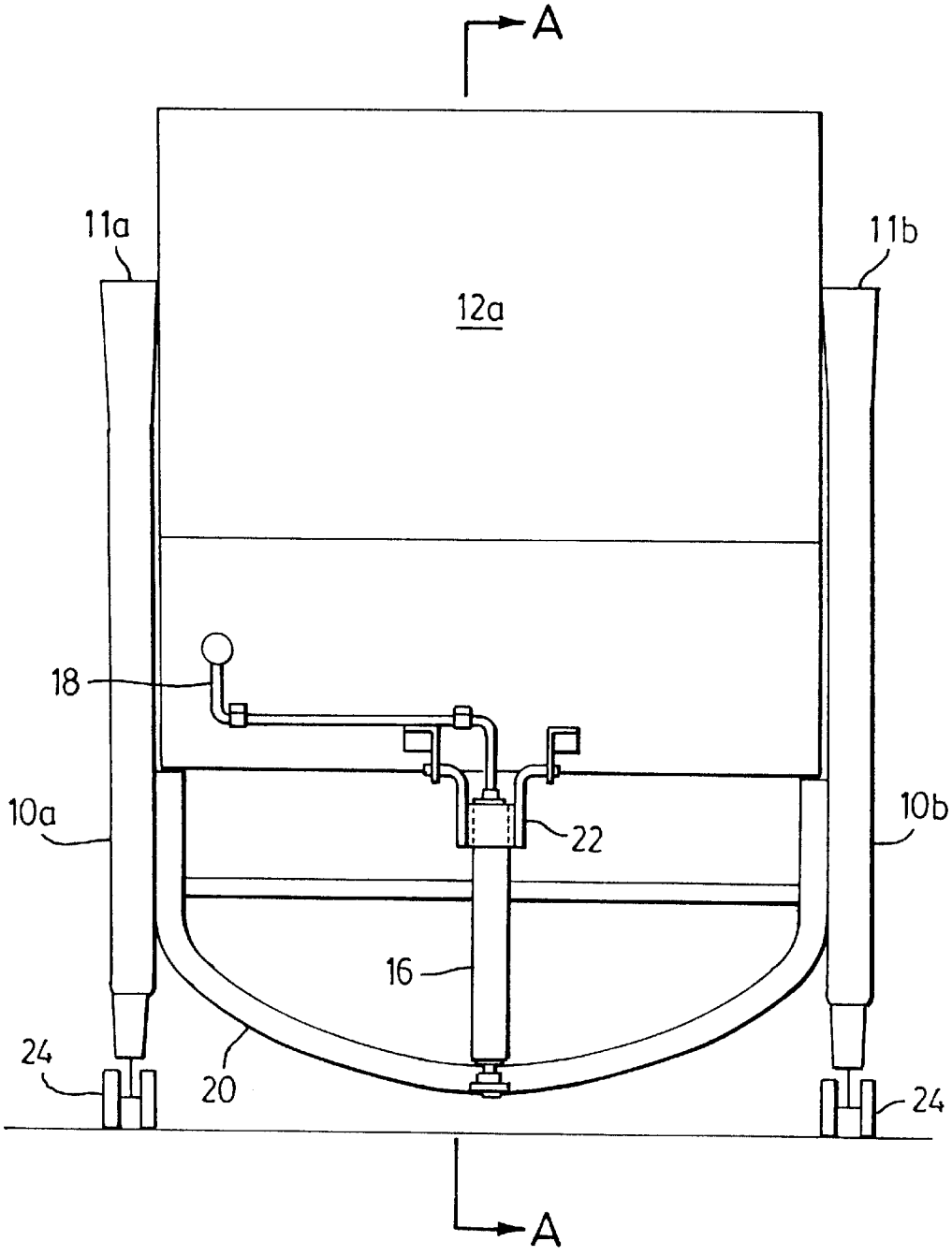
FIG. 1 is a rear elevational schematic view of a chair according to the present invention.
Figure 2:
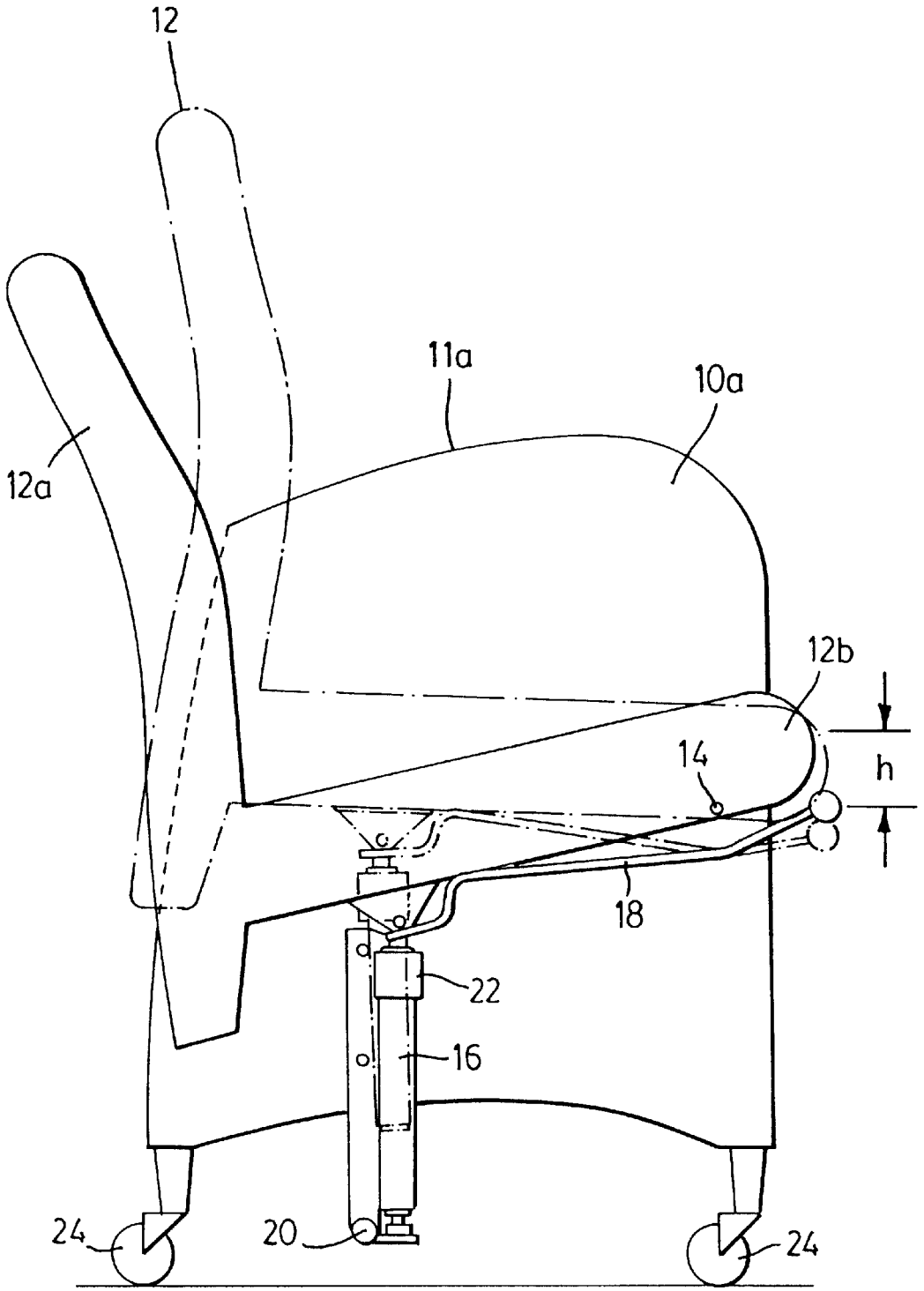
FIG. 2 is a cross-sectional view taken along line A—A of FIG. 1.

A one-piece seat/back unit 12 is mounted at each side of the seat portion 12*b* to the arms 10*a* and 10*b* by pivot pins 14 or other suitable means to permit pivoting as the seat portion 12*b* is lifted and the back portion 12*a* tilted forward. In FIG. 2, the extent to which the juncture of back portion 12*a* and seat portion 12*b* may be raised or lowered in use is indicated as h.

The lifting of the seat portion and forward tilting of the back portion of the assembly is driven by pneumatic cylinder means which may be actuated or deactuated by control lever 18 which extends forwardly from the cylinder to just under the chair front and acts as a lever for depressing or releasing a control pin on the pneumatic cylinder means.

As the pneumatic cylinder means in a chair according to the invention, there may usefully be used a "gas spring", such as the SUSPA (trade-mark) Series 16. A gas spring is an hermetically-sealed hydropneumatic linear actuator containing a pressurized gas ($N_2$) to provide an output force. The gas spring also contains a specific volume of oil to lubricate the seal, piston and piston rod. The piston rod which moves within the cylinder extends outside of the gas-pressurized cylinder tube when the spring is in its unloaded static state, but as the piston rod is compressed, the piston surface impresses upon the gas cushion in the cylinder causing the internal pressure and output force to be increased according to the volume displacement of the piston rod. Conversely, during extension of the piston rod, the internal pressure and output force decrease, dependent upon the reduction of internal rod volume.

Such gas cylinders have been widely used in office chairs, to provide to suitable damped springing effect when someone sits down onto the seat of the chair. In chairs according to the present invention, compactness of structure and ease of use are afforded by providing a tubular cross-member 20 which serves both to support the pneumatic cylinder 16 at its lower end and, by fixed connection to arms 10*a* and 10*b* to provide strength and support for the chair assembly as a whole.

The angular tilt of seat portion 12*b* as it is raised by cylinder means 16 over the distance h is compensated by providing a pivotal connection means between the top of the pneumatic cylinder and the underside of the seat portion, such as a swivelling bracket 22.

The flat vertical arms 10*a* and 10*b* of the chair according to the invention allow the ready mounting of any number of accessories to the sides of the chair which are useful in meetings for example a writing tablet, a tote for briefcases, laptops, purses, binders, etc., a cup holder, and so on. A preferred form of construction which lends itself to attractive design is use of a tubular steel body frame molded into CFC-free fire retardant, cold-cured, high resiliency urethane, with rigid urethane glass reinforced arm frame over steel. That affords a lightweight construction so that the chair is readily translatable when provided with conventional casters 24.

Typically, the construction of the chair according to the invention will permit a range of continuous adjustment from a forward tilt of 2° of the back portion 12*a* (for poring over documents) to a full recline of 12° for conversation or contemplation.

While a particular form of chair and certain specific arrangement of parts has been illustrated, it will be appreciated that variations to the present arrangement may be used without parting from the spirit of the invention as defined in the appended claims.

We claim:

1. A chair with adjustable seating angle, comprising:

a pair of laterally spaced vertical side walls;

ground contacting support means mounted to the underside of said vertical side walls;

an elongate supporting cross-member extending between and fixedly mounted to said side walls below seat level;

an integral chair back/seat assembly extending laterally between said vertical side walls;

means for pivotally mounting the front of said seat portion to said side walls;

pneumatic cylinder means connected centrally to said cross-member at a first end of said pneumatic cylinder means, and connected at the second end thereof to the underside of the seat portion by pivotal connection means, for lowering of the seat portion with a rearward tilting of the back portion in response to the weight of a user, and raising of the seat portion with forward tilting of the back portion when the weight of a user is removed; and manually operable control means for actuating said pneumatic cylinder means when adjusting the inclination of said assembly and for deactuating the pneumatic cylinder means to set a desired inclination of the assembly.

2. A chair according to claim 1, wherein said pneumatic cylinder means is a gas spring.

3. A chair according to claim 2, wherein said manually operable control means comprises a control pin on said pneumatic cylinder means and a control rod extending forwardly under the seat to the front thereof for manual adjustment.

4. A chair according to claim 2, wherein said ground contacting support means comprises four casters symmetrically disposed on the underside of said vertical side walls at the front and rear thereof for translational moveability of the chair.

5. A chair according to claim 2, wherein said vertical side walls have convexly contoured edge surfaces to serve as arm rests for the user of the chair.

6. A chair according to claim 2, wherein said means for pivotally mounting the front of said seat portion to said side walls comprises a pair of transversely opposed pivot pins projecting through said side walls and into corresponding locations at the sides of said seat portion.

7. A chair according to claim 2, wherein said pivotable connection means comprises a swivel bracket centrally mounted to the underside of said seat portion and connectable to said first end of the pneumatic cylinder means.

* * * * *